US011731740B1

(12) United States Patent
Hamilton, Sr. et al.

(10) Patent No.: US 11,731,740 B1
(45) Date of Patent: Aug. 22, 2023

(54) DUAL DIRECTION SLIDING BACKREST FOR MARINE VESSELS

(71) Applicants: John Hamilton, Sr., Mims, FL (US); Carrie Fodor, Cape Canaveral, FL (US); Matthew Layden, Merritt Island, FL (US); Chadley Jaziri, Cocoa Beach, FL (US); Erin Schwarz, Rockledge, FL (US)

(72) Inventors: John Hamilton, Sr., Mims, FL (US); Carrie Fodor, Cape Canaveral, FL (US); Matthew Layden, Merritt Island, FL (US); Chadley Jaziri, Cocoa Beach, FL (US); Erin Schwarz, Rockledge, FL (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/391,631

(22) Filed: Aug. 2, 2021

Related U.S. Application Data

(63) Continuation of application No. 16/291,695, filed on Mar. 4, 2019, now abandoned, which is a continuation of application No. 15/411,751, filed on Jan. 20, 2017, now abandoned.

(51) Int. Cl.
*B63B 29/06* (2006.01)
*B63B 29/04* (2006.01)

(52) U.S. Cl.
CPC ..... *B63B 29/06* (2013.01); *B63B 2029/043* (2013.01)

(58) Field of Classification Search
CPC ..... B63B 29/04; B63B 29/06; B63B 2029/04; B63B 2029/043; B63B 2709/00; B60N 2/143; B60N 2/203
USPC ..... 114/343, 363, 364
See application file for complete search history.

(56) References Cited

U.S. PATENT DOCUMENTS 1,443,479 A * 1/1923 Lambert ..... B61D 33/0028 297/94
2,383,178 A * 8/1945 Edwards ..... B63B 29/02 297/94
3,113,804 A * 12/1963 Ritter ..... B63B 29/06 108/140
3,163,409 A * 12/1964 Running ..... A47C 3/023 267/285

(Continued)

*Primary Examiner* — Daniel V Venne
(74) *Attorney, Agent, or Firm* — Dale Paul DiMaggio; Malin Haley DiMaggio & Bowen, P.A.

(57) ABSTRACT

A seating system for marine vessels including a seat back, a seat cushion, and a seat substructure. The seat substructure is disposed beneath and supports the seat cushion. The seat substructure includes bi-lateral curved tracks and the seat back is slidingly engaged with each of the bi-lateral curved tracks. A seat arm is attached to either side of said seat back, extending through said seat cushion and slidingly attached to a respective bi-lateral curved track. A friction-defeating traveler track can be attached to the seat arm and engages the track. The seat back is readily moveable along the bi-lateral curved tracks between at least a first position and a second position along said track. The seat can be translated along the tracks between at least the two positions with one hand without the need to release or lock any mechanism.

5 Claims, 4 Drawing Sheets

(56) References Cited

U.S. PATENT DOCUMENTS

| | | | | | |
|---|---|---|---|---|---|
| 4,544,199 | A * | 10/1985 | Wrigley | B63B 29/04 | 297/63 |
| 5,322,341 | A | 6/1994 | Harrison et al. | | |
| 5,463,972 | A * | 11/1995 | Gezari | B63B 29/04 | 297/363 |
| 5,799,605 | A * | 9/1998 | Huse | B63B 29/04 | 114/363 |
| 7,125,076 | B2 | 10/2006 | Beranek et al. | | |
| 7,281,761 | B2 | 10/2007 | Brown et al. | | |
| 7,387,338 | B2 | 6/2008 | Beranek et al. | | |
| 7,484,795 | B2 | 2/2009 | Saint-Jalmes et al. | | |
| 7,513,211 | B1 * | 4/2009 | Farb | B63B 29/04 | 114/363 |
| 8,740,297 | B1 | 6/2014 | Foss et al. | | |
| 2003/0075098 | A1 * | 4/2003 | Huse | B63B 29/04 | 297/63 |
| 2003/0155798 | A1 * | 8/2003 | Butler | A47C 7/282 | 297/452.56 |
| 2005/0247255 | A1 * | 11/2005 | Huse | A47C 17/161 | 114/363 |
| 2015/0076874 | A1 * | 3/2015 | Neese | B63B 29/04 | 297/383 |

* cited by examiner

DUAL DIRECTION SLIDING BACKREST FOR MARINE VESSELS

CROSS REFERENCE TO RELATED APPLICATIONS

This application is a Continuation of U.S. Utility patent application Ser. No. 16/291,695 filed on Mar. 4, 2019, now abandoned, which is a Continuation of U.S. Utility patent application Ser. No. 15/411,751 filed on Jan. 20, 2017, now abandoned.

STATEMENT REGARDING FEDERALLY SPONSORED RESEARCH OR DEVELOPMENT

N/A

BACKGROUND OF THE INVENTION

1. Field of the Invention

The present invention generally relates to marine vessels and watercraft and more particularly to a dual position seating system for marine vessels and watercraft.

2. Description of Related Art

Marine vessel and watercraft designs have included a variety of seating arrangements and designs for the boaters. Specifically, there are many different designs for seats located within a boat, especially for open topped boats commonly used for day trips of limited duration for recreational or sport fishing purposes. Many seats provide the user with a variety of positions in which to sit such as forward-facing, aft-facing, lounging, etc. However, due to the limited space within a boat, these different positions must be operable within small parameters, necessitating thoughtful and ergonomic design.

Typically, modern boats have seats which are rigidly fixed and can only change from providing an upright position to providing a reclining position while facing a single direction. Swivel seats are often used to change the orientation of seating position, i.e. from bow-facing to stern-facing, but suffer from unintended movement and generally lack stability in a marine environment. Some attempts have been made to provide reversible seating for marine vessels but they typically rely on complicated and cumbersome tracks, springs, and release mechanisms in order for the seat to manually move from one position to the other. Such common designs require two-hand operation: one hand to release the seat back and another hand to support and move the seat back to the desired position. Other options, like "flip flop" or hinged seat backs are often equally cumbersome and are typically unsightly, space consuming, and generally intrusive.

Although prior designs have sought to improve the structure, operation, and utility of seats on marine vehicles, these designs have failed to adequately maximize space and ease of use while allowing for multiple seating position. For example, U.S. Patent Application Publication No. 2015/0076874 to Neese et al. discloses a movable/slidable backrest for a boat lounge or seat, wherein the backrest may be positioned at multiple locations depending on user preferences. The backrest can be positioned in a central location, or alternatively locked in forward or aft positions, and can be tilted. This assembly utilizes an internal rail system with a lock-pin in the seat base acting as a carriage positioned beneath the lounge seat. The carriage is on wheels which roll along horizontal rails. This system is disadvantageous in that it requires an exposed lock-pin and two hands to operate. U.S. Pat. No. 8,740,297 to Foss, commonly owned by this Applicant relates to a reversible seat having guide bars and back rest support assemblies. The guide bars are attached to the sides of the seat bottom and are positioned outside of the base assembly. The backrest is secured between the backrest support assemblies. The support assemblies include two or more spindles and a spindle carrier. The spindles rotate within the respective guide bars providing a sliding engagement of the backrest. This disadvantage of this design is the track and related hardware is exposed to the user, the system requires two hands to operate, and the backrest must be configured to tilt and/or rotate in order to be properly positioned when moved along the track through the various seating positions.

It is, therefore, to the effective resolution of the aforementioned problems and shortcomings of the prior art that the present invention is directed. However, in view of the marine vessel seating systems in existence at the time of the present invention, it was not obvious to those persons of ordinary skill in the pertinent art as to how the identified needs could be fulfilled in an advantageous manner.

SUMMARY OF THE INVENTION

The present invention comprises various embodiments of a seating system useful on marine vessels including a seat back, a seat cushion, and a seat substructure. The seat substructure is disposed beneath and supports the seat cushion. The seat substructure includes bi-lateral curved tracks and the seat back is slidingly engaged with each of the bi-lateral curved tracks. In some embodiments, a seat arm is attached to either side of said seat back, extending through said seat cushion and slidingly attached to a respective bi-lateral curved track. A friction-defeating traveler track can be attached to the seat arm and engages the track. The seat back is readily moveable along the bi-lateral curved tracks between at least a first position and a second position along said track. The seat can be translated along the tracks between at least the two positions with one hand without the need to release or lock any mechanism.

Accordingly, it is an object of the present invention to provide a seating system for marine vessels that is easily operable between at least two positions with one hand and without the need for a lock or release device.

It is another object of the present invention to provide a seating system for marine vessel with minimal exposed hardware.

It is another object of the present invention to provide a seating system for marine vessels that is ergonomic and simple to operate while provide optimal diversity and modularity.

In accordance with these and other objects which will become apparent hereinafter, the instant invention will now be described with particular reference to the accompanying drawings.

DETAILED DESCRIPTION

Figure 1:
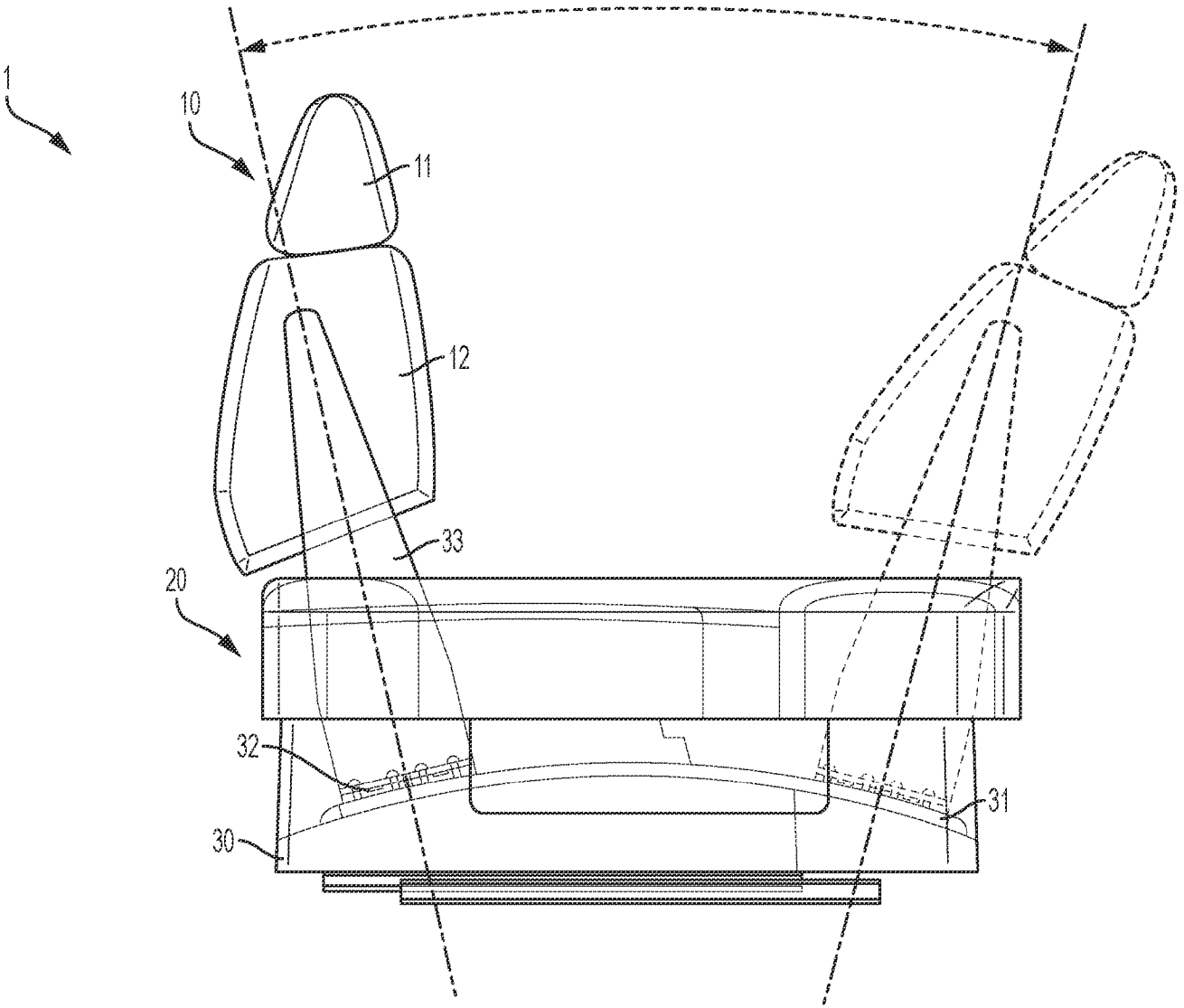
FIG. 1 is an exploded side view of one embodiment of the seating system.

With reference to FIG. 1, shown is an embodiment of the seating system 1 which is a marine vessel deck seat for securing to a marine vessel deck, and includes a seat back 10, a seat cushion 20, and a seat substructure 30. The seat cushion 20 is disposed on top of seat substructure 30, with the substructures disposed beneath and support the seat cushion 20. The seat cushion 20 and substructure 30 together define a seat bottom on which an individual can sit or rest. The seat cushion 20 provide comfort and conceals hardware and moving parts to prevent injury and enhance ergonomics and aesthetics. The seat back 10 is attached to the seat substructure 30 and extends upward therefrom and through the seat cushion. The seat back 10 is, in some embodiments, oriented substantially perpendicular to the seat cushion 10 or, alternatively, slightly pitched from perpendicular to provide a comfortable seating position for the user.

In some embodiments, the seat back 10 comprises an upper cushion 11 and a lower cushion 12 although the seat back 10 may, in some embodiments, comprise a single cushion. Disposed and attached on either side of the seat back 10 are seat arms 33 and 33'. The seat arms 33 and 33' extend downward from the seat back 10, through the seat cushion 20 and are attached to the seat substructure 30. In some embodiments, the seat arms 33 and 33' each terminate at a traveler bracket 32 that is slidingly engaged with a curved track 31. As shown in FIG. 1, the curved track 31 provides a range of motion for the seat back 10 such that at the extreme lateral positions, the seating system 1 selectively provides two opposing seating positions. In the figures, the two possible seating positions are shown in solid lines and ghosted lines for ease of reference. In the context of a marine application this may allow for a combination forward-aft seat or a combination port-starboard seat, among many other possible orientations.

Figure 2:
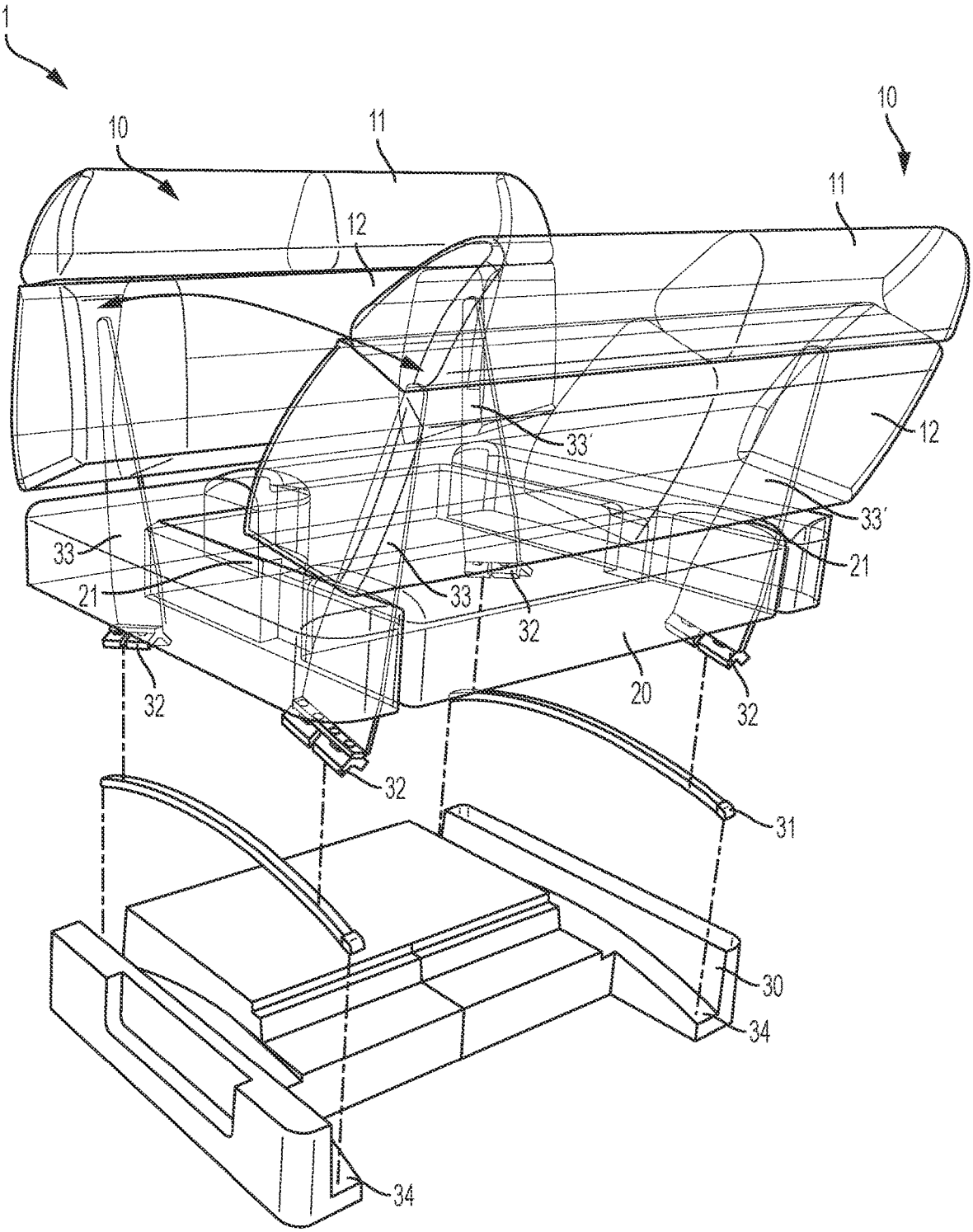
FIG. 2 is an exploded perspective view of one embodiment of the seating system.

FIG. 2 is a perspective exploded view that depicts additional features of the seating system and marine vessel deck seat 1. Here, the seat substructure 30 is to be secured to a marine vessel deck and is shown separated from the seat cushion 20. In some embodiments, the substructure 30 has bi-lateral curved channels that receive and seat the curve bi-lateral curved tracks 31. The substructure 30 also provides support and shaping features for the seat cushion 20. In some embodiments, the seat cushion 20 include bi-lateral slots 21 through which the seat arms 33 and 33' pass. The slots 21 can also assist the action of the seat back 10, acting as a secondary guide while the seat back 10 and arms 33 and 33' translate across the tracks 31. The traveler brackets 32 disposed at the end of each arm 33 and 33' may include a ball bearing or roller bearing engagement or other similar friction-defeating engagement to ensure smooth action of the seat back 10. Such an engagement also promotes easy, one-hand use of the seating system 10 without the need for pin-locks, releases, or other cumbersome components. The curved nature of the tracks 31 provides that the seat back will travel in an arcuate manner from the first position to the second position and will remain relatively locked into a given position as the curvature of the track will generally prevent unintended movement of the seat back. With appropriate manual force applied, the seat back will easily and swiftly translate from one position to the other with minimal effort.

With further reference to FIGS. 1 and 2, seat arms 33 and 33' are secured on top of traveler brackets 32 where the seat arms terminate at their base as described above, and are generally vertically aligned with traveler brackets 32, also as illustrated. The seat arms, traveler brackets, curved tracks 31, and recessed channels 34 about base 30 are also all generally vertically aligned as illustrated which allows for the movement and sliding engagement of the arms and cushions as described.

Bi-lateral curved tracks 31 are secured to substructure 30 on curved base surfaces, recessed channels 34, which receive curved tracks 31 and are geometrically complementary thereto as shown in FIG. 2. The substructure 30 can be secured to the marine vessel deck at any desired location.

As shown in FIGS. 1 and 2 and discussed above, the marine vessel deck seat 1 allows for the seat back to translate across the seat cushion in order to be oriented in a plurality of positions, including a first position and an opposing second position, which provide different seating positions and orientations. Additionally, the curved shaped of the track causes the angle of the seat back 10 to change or deviate as it moves along the curved track 31, assuring that the seat back 10 is in the optimal and ergonomic position once it reaches it desired position at the ends of the track 31. This eliminates the need for a swiveling or pivoting seat back that is common in prior art seating systems.

In some embodiments, the marine vessel deck seat 1 may utilize bi-lateral tracks as shown, each engaged with a seat arm. Alternatively, a single arm 33 may be provided and engaged with a single curved track by way of the traveler bracket. This reduces the number of moving parts and can be convenient in certain installations and applications where space is limited at is advantageous to have the seat back supported by only a single seat arm.

Figure 3:
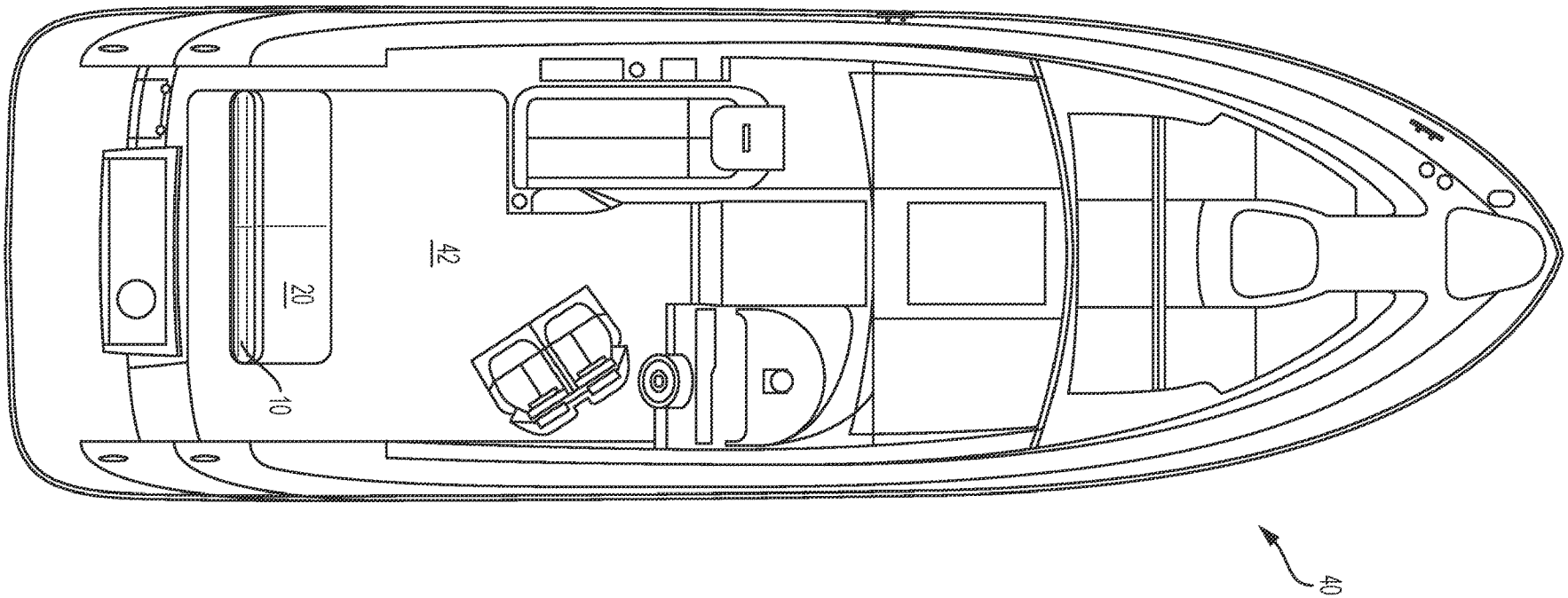
FIG. 3 is top view of one embodiment of the seating system and marine vessel deck seat installed on a marine vessel deck.

FIG. 3 is a top view of a marine vessel 40 having the instant seating system and marine vessel deck seat 1 installed on marine vessel deck 42. In this embodiment, the deck seat is shown in the aft section of the boat deck, on the port side, with the deck seat back 10 in the rear position shown, such that boaters when seated on seat cushion 20 are facing forward towards the bow of the boat.

Figure 4:
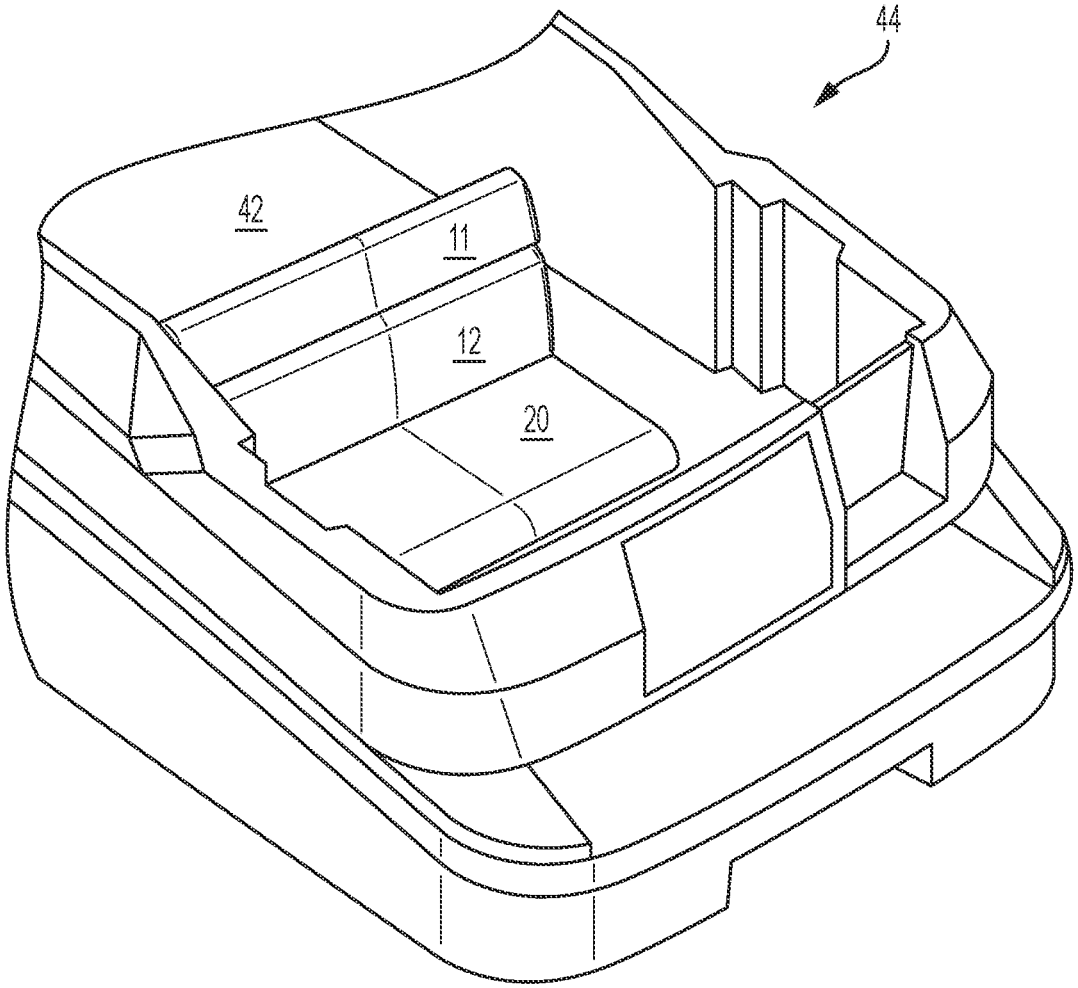
FIG. 4 is a partial perspective view of the embodiment of the seating system and marine vessel deck seat installed on a marine vessel deck as shown in FIG. 3.

FIG. 4 is a partial perspective view of the embodiment of the instant seating system and marine vessel deck seat 1 in the aft section of the boat deck 42, with deck seat back 10, and upper cushion 11 and lower cushion 12, repositioned and translated to the forward position shown, such that boaters when seated on seat cushion 20 are facing rearward towards the stern of the boat.

It is appreciated that the present seating system 1 can comprise a variety of materials commonly used in construction of marine vessels and watercraft including fiberglass, resins, plastics, vinyls, foams, and combinations thereof. Furthermore, it is appreciated that the seating system 1 can be installed as a matter of choice in any desired location on a marine vessel deck or watercraft including on the deck, in the cockpit, at the front of the vessel or elsewhere. It is appreciated that the seating system of the present invention is not limited for use in connection with marine vessels and watercraft although the system is particularly well suited for such applications. Finally, it is understood that the size, shape and overall dimensions of the seating system 1 is not limited to those dimensions inferred from the drawings herein. The invention is designed to be scalable for a variety of applications without departing from the novel structure and function described herein.

While specific embodiments have been described in detail in the foregoing detailed description and illustrated in the accompanying drawings, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A marine vessel deck seat, for a marine vessel deck, said marine vessel deck seat comprising:

a seat back, a seat cushion, and a seat substructure;

said seat substructure for securing said marine vessel deck seat to said marine vessel deck;

said seat substructure including at least one recessed curved channel;

said seat substructure including at least one elevated curved track;

said seat substructure disposed beneath and supporting said seat cushion;

said seat back slidingly engaged with said elevated curved track of said seat substructure;

said seat back being slidingly attached to said elevated curved track by way of a seat arm extending through said seat cushion to said seat substructure;

said elevated curved track being separate from, and secured atop, said recessed curved channel; and said seat back is moveable between at least a first position and a second position along said track.

2. The marine vessel deck seat of claim 1, wherein said seat arm is engaged with said elevated curved track by a traveler bracket;

said seat arm secured atop said traveler bracket and vertically aligned therewith; and said traveler bracket secured atop said elevated curved track atop said recessed curved channel and vertically aligned therewith.

3. The marine vessel deck seat of claim 1, wherein said seat substructure includes bi-lateral elevated curved tracks, said seat back slidingly engaged with both said elevated curved tracks.

4. A marine vessel deck seat, for a marine vessel deck, said marine vessel deck seat comprising:

a seat back, a seat cushion, and a seat substructure;

said seat substructure for securing said marine vessel deck seat to said marine vessel deck;

said seat substructure including recessed curved channels;

said seat substructure disposed beneath and supporting said seat cushion;

said seat substructure including bi-lateral elevated curved tracks;

said elevated curved tracks being separate from, and secured atop, said recessed curved channels;

said seat back slidingly engaged with each of said bi-lateral elevated curved tracks of said seat substructure;

a seat arm is attached to either side of said seat back, each of said seat arms extending through said seat cushion and slidingly attached to a respective one of said bi-lateral elevated curved tracks; and said seat back is moveable along said bi-lateral elevated curved tracks between at least a first position and a second position along said bi-lateral elevated curved tracks.

5. The marine vessel deck seat of claim 4, wherein a traveler bracket engages a respective said seat arm with a respective said elevated curved track;

each said seat arm secured atop said traveler bracket and vertically aligned therewith; and said traveler bracket secured atop said elevated curved track atop said recessed curved channel and vertically aligned therewith.

* * * * *